US010213354B2

(12) United States Patent
Fich

(10) Patent No.: US 10,213,354 B2
(45) Date of Patent: Feb. 26, 2019

(54) WHEELED TRANSPORTATION DEVICE

(71) Applicant: IDEAssociates (IOM) Limited, Douglas (GB)

(72) Inventor: Preben B. Fich, Donnybrook (IE)

(73) Assignee: IDEAssociates (IOM) Limited, Douglas, Isle of Man (GB)

( * ) Notice: Subject to any disclaimer, the term of this patent is extended or adjusted under 35 U.S.C. 154(b) by 148 days.

(21) Appl. No.: 15/511,510

(22) PCT Filed: Sep. 18, 2014

(86) PCT No.: PCT/EP2014/069918
§ 371 (c)(1),
(2) Date: Mar. 15, 2017

(87) PCT Pub. No.: WO2016/041599
PCT Pub. Date: Mar. 24, 2016

(65) Prior Publication Data

US 2017/0281441 A1 Oct. 5, 2017

(51) Int. Cl.
*A61G 7/08* (2006.01)

(52) U.S. Cl.
CPC ..... *A61G 7/08* (2013.01)

(58) Field of Classification Search
CPC .. A61G 7/08; A61G 2203/16; A61G 2203/12; A61G 2203/80; A61G 2203/22;
(Continued)

(56) References Cited

U.S. PATENT DOCUMENTS 5,580,207 A 12/1996 Kiebooms et al.
8,016,303 B1 * 9/2011 Ullman ..... B62B 5/0083 280/79.4
8,165,718 B2 4/2012 Ota et al.
(Continued)

FOREIGN PATENT DOCUMENTS

CA 2 408 087 A1 11/2001
EP 0 358 628 A2 3/1990
(Continued)

OTHER PUBLICATIONS

International Search Report and Written Opinion dated Feb. 6, 2015 for PCT/EP2014/069918.

*Primary Examiner* — Jaime Figueroa
(74) *Attorney, Agent, or Firm* — Fox Rothschild LLP; Carol E. Thorstad-Forsyth

(57) ABSTRACT

An autonomous wheeled transportation device (1) for transporting beds and other items. The wheeled transportation device (1) comprises a base, with a lower part having a number of wheels (8, 12, 22). The autonomous wheeled transportation device (1) comprises at least one movable first engagement member (13) adapted to engage a frame part (14) of a bed, the movable first engagement member being movable between a resting engagement member position at or below a plane and horizontal surface (6) of the wheeled transportation device (1), and an activated engagement member position in which the movable first engagement member (15) engages the frame part (14) of the bed. The autonomous wheeled transportation device (1) comprises a further engagement member (19) located above said at least one substantially horizontal and plane surface (6), and adapted to engage a patient support base of the bed.

16 Claims, 14 Drawing Sheets

Figure 1:
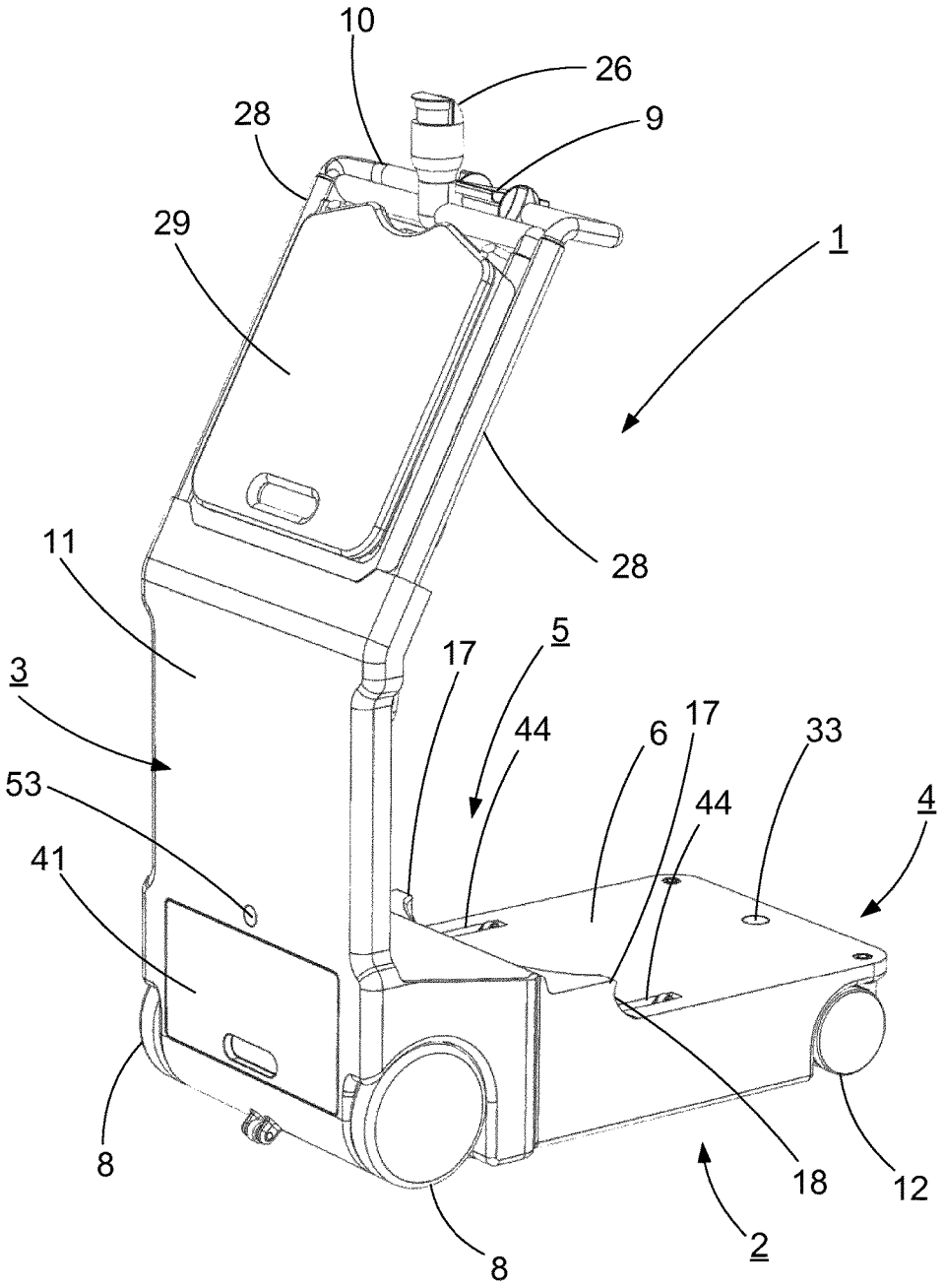

(58) Field of Classification Search
CPC .. A61G 7/1048; A61G 2203/20; A61G 5/047; B66C 23/48; B66F 9/063; B62B 2202/90; B62B 5/0079; B62B 5/0006
USPC ..... 701/1, 22
See application file for complete search history.

(56) References Cited

U.S. PATENT DOCUMENTS 8,240,410 B2 * 8/2012 Heimbrock ..... A61G 7/018 180/19.1
8,516,637 B2 * 8/2013 Karwal ..... A61G 7/005 5/510
8,790,061 B2 * 7/2014 Yamashita ..... B65G 1/0492 414/280
9,913,771 B2 * 3/2018 March ..... A61G 7/08
9,919,906 B2 * 3/2018 March ..... A61G 7/08
2003/0159861 A1 * 8/2003 Hopper ..... A61G 7/08 180/22
2004/0213656 A1 * 10/2004 Lear ..... A61G 7/08 414/495
2008/0223649 A1 * 9/2008 Wandeler ..... A61G 3/065 180/333
2010/0064431 A1 * 3/2010 Kawakami ..... A61G 7/1017 5/81.1 RP
2012/0029697 A1 * 2/2012 Ota ..... A61G 7/08 700/253
2016/0193095 A1 * 7/2016 Roussy ..... A61G 7/002 5/11

FOREIGN PATENT DOCUMENTS

WO 03 024378 A2 3/2003
WO 2004/020267 A2 3/2004
WO 2006/014001 A1 2/2006
WO 2006/047351 A2 5/2006
WO 2013/054660 A1 4/2013
WO 2014/057313 A1 4/2014

* cited by examiner

WHEELED TRANSPORTATION DEVICE

CROSS REFRENCE TO RELATED APPLICATION

The present application claims benefit of International Patent Application (PCT) No. PCT/EP2014/069918 filed on Sep. 18, 2014, which application is incorporated herein by reference in its entirety.

The present invention relates to a wheeled transportation device, preferably an autonomous vehicle for hospitals.

In modern hospitals, there is a trend towards lower rise buildings with a large area of extension rather than high rise buildings. Ideally such hospitals have fewer or only a single level for treatment, examination, consultation, accommodation, kitchen, other support facilities etc. This reduces the need for the use of elevators, ramps and stairs to overcome differences in level. This however comes at the expense of longer distances to be travelled. Not necessarily by the patients, as the trend is also going towards single bed rooms, allowing parts of treatment, examination, consultation and the like to be decentralised, i.e. take place in the patients room, rather than in a central room allocated to that purpose.

Such longer distances involves increased travel or transportation time and increases the ergonomic and physical strain on the personnel, when handling heavy objects with high inertia, such as hospital beds. There is therefore a need of automotive, automated and autonomous transportation devices aiding in covering these longer distances to be travelled. In this respect numerous solutions have been proposed.

U.S. Pat. No. 5,580,207 proposes an electrically propelled transportation device to be inserted under one end of a hospital bed from the end thereof. The device has lifting means which may lift one end of the bed, in particular the wheels at that end, off the ground. This gives better control of the bed during transport, which may otherwise be difficult, especially if all four wheels on the bed are swivel wheels, even if some of the swivel wheels are locked about their vertical axis. This transportation device is solely suitable for beds. It furthermore has the drawback it must be quite rugged in order to carry approximately half the weight of a bed, which can be substantial if the bed is occupied with a patient.

WO-A-03/014001 also proposes an electrical transportation device. This device is also adapted to be inserted under a hospital bed from one end thereof in order to lift that end of the bed off the ground. For this the device has a lifting means that may be lifted to various heights over a top surface of the device. The lifting means is adapted to engage a cross-member of a bed. The device has two independently powered drive wheels at the front and two swivel wheels at the back. This device also intends to lift the weight of the bed and accordingly needs to be rugged. It is furthermore neither automated nor autonomous.

U.S. Pat. No. 8,165,718 proposes an autonomous transportation device. This transportation device is also adapted to be inserted under a hospital bed from one end thereof. The device has engagement means engaging the wheels of the bed, allowing therefore not only beds to be transported, but also other wheeled devices such as wheelchairs. This device is both automotive and autonomous but it still carries the weight of the bed.

For transportation of other items than beds in hospitals, such as delivering mail, linen, blood samples, food or other items, autonomous transportation devices are known from inter alia EP-A-358628 and WO-2004/020267. These transportation devices are, however, unsuitable for transporting beds.

On the background of this prior art it is the object to provide an improved and more versatile transportation device for transporting objects, in particular beds, in hospitals. According to the present invention this object is achieved by a wheeled transportation device comprising a base, where the base comprises a front end, a rear end, an upper part and a lower part, said lower part comprising a number of wheels and said upper part comprising at least one substantially horizontal and plane surface, said wheeled transportation device comprising at least one movable first engagement member adapted to engage a frame part of a bed, said movable first engagement member being movable between a resting engagement member position and an activated engagement member position, said movable first engagement member extending above said substantially horizontal and plane surface in the activated engagement member position, wherein said upper part comprises a further engagement member located above said at least one substantially horizontal and plane surface.

These features allow the transportation device to enter into engagement with a bed in such a manner that the wheeled transportation device may be lifted upward from the ground to a height where only some of said number of wheels remain in contact with the ground. This, in turn, allows reduction of the load on the wheels in contact with the ground, and on the wheeled transportation device in general, to a level, which is sufficient to ensure the friction necessary for driving the bed, but is not overly stressing the transportation device, including the wheels.

According to a preferred embodiment of the invention, the resting engagement member position is located at or below said at least one substantially horizontal and plane surface. Placing the engagement member in a resting position at or below the at least one substantially horizontal surface, i.e. retracted, allows the substantially horizontal surface to be free of obstacles and thus conveniently serve as a transportation device for other objects than beds, e.g. personnel. Raising the engagement member to an activated position may on the other hand serve to lift a load, such as a pallet to be transported by the transportation device.

According to a further preferred embodiment, said movable first engagement member comprises a pair of hook members. Using a pair of hooks allows a stable grip on the frame part of a bed.

According to another preferred embodiment, said number of wheels comprise a first pair of drive wheels arranged with coinciding first axes of rotation, each wheel in said pair being driven by an individually controllable electric motor. This allows simple steering of the wheeled transportation device, as well as for the transportation device to be highly manoeuvrable, allowing it inter alia to turn in a very narrow turning circle.

According to yet another preferred embodiment, said number of wheels comprise a second pair of drive wheels arranged with coinciding second axes of rotation orthogonal to said coinciding first axes of rotation, each wheel in said pair being driven by an individually controllable electric motor, said second pair of wheels being movable between a retracted resting position and an activated position. Having a second pair of drive wheels allows the transportation device to enter under a bed from the side, rather than an end part thereof. Thereby, when the first pair of drive wheels has been lifted off the ground, the second set of wheels may be lowered and used for driving the bed. This can be done without excessive load on the second pair of drive wheels, because the downward force need only to establish sufficient friction for traction, but not to support the weight of the bed.

According to another preferred embodiment, the wheeled transportation device is generally symmetrical about a longitudinal vertical plane, and wherein the coinciding second axes of rotation are arranged in said longitudinal vertical plane. This has the advantage that by activating the second pair of wheels, the wheeled transportation device gains additional degrees of freedom in manoeuvrability, as it may not only move sideways, but also turn on the spot, i.e. with a turning circle hardly, exceeding its own horizontal dimensions. It can thus get into almost any corner, and it can easily position itself with respect to any object of interest. Furthermore, being able to turn itself, and hence the bed on the spot, substantially reduces the physical stress on the porter, as he needs not himself apply the force to turn a heavy bed with a patient, in order to manoeuvre it.

According to a further preferred embodiment, said further engagement member is adapted to engage a patient support base of a bed. This allows the built-in elevation mechanism for the patient support base of the bed to be used for lifting the transportation device off the ground. This, in turn, has the advantage that the wheeled transportation device may be held level, so as to ensure the same the downward force on each of the wheels of the second pair of drive wheels. Having the same downward force on the each of the wheels ensures that they are subject to the same degree of wear. If as preferred the wheels are spring loaded with only a bias to ensure sufficient friction for traction, the wear on the wheels and the floor surface will be further reduced.

According to yet another preferred embodiment, the further engagement member is a downwardly open fixed hook member. This allows for easy engagement between the patient support base of the bed and the transportation device, so as to efficiently stabilize and secure the transportation device with respect to the whole bed.

According to another preferred embodiment, the wheeled transportation device further comprises a movable pin with a vertical longitudinal axis, the pin being movable along said vertical longitudinal axis. This, pin serves dual functions as locking pin for the tow bar of a trailer, as well as additional lifting and securing means for a lifted pallet.

According a further preferred embodiment, the wheeled transportation device comprises a built-in control computer, sensors, control means for motors and communication means. This allows the wheeled transportation to act and interact autonomously, in particular by negotiating the attachment to a bed. Thus according to a further preferred embodiment the computer comprises software adapted for autonomous control, including navigation, of the transportation device based on input from said sensors.

According to yet a further preferred embodiment, the wheeled transportation device comprises manual input devices adapted to allow manual control of the wheeled transportation device. This allows the wheeled transportation device to be operated by personnel, such as porters and the like, e.g. when transporting a patient in a bed.

According to another embodiment, the at least one movable first engagement member is adapted to engage at least one horizontal beam in a frame part of a bed. This, together with the second engagement member, allows the wheeled transportation device to be releasably attached to the bed.

Figure 2:
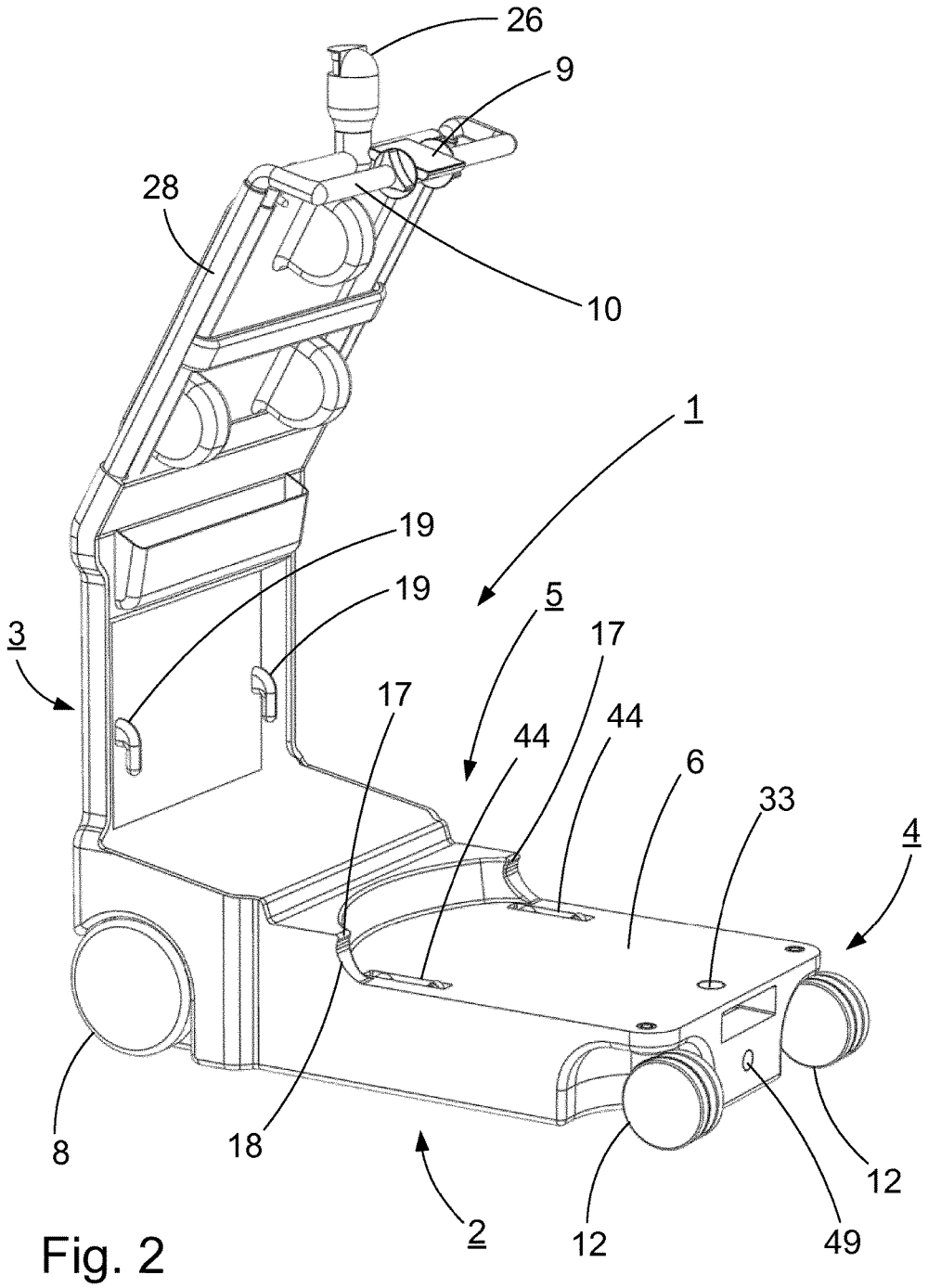
Figure 3:
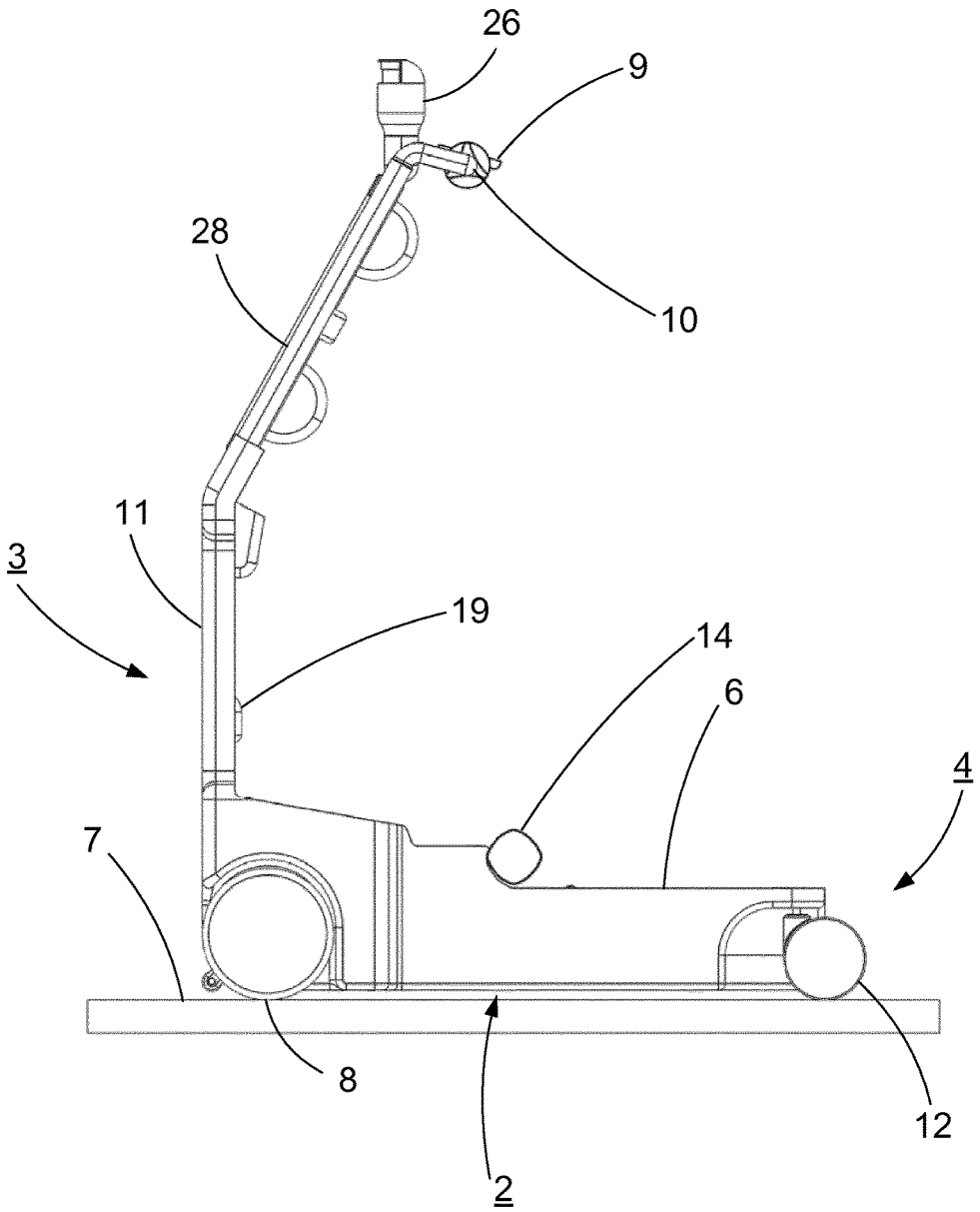
Figure 4:
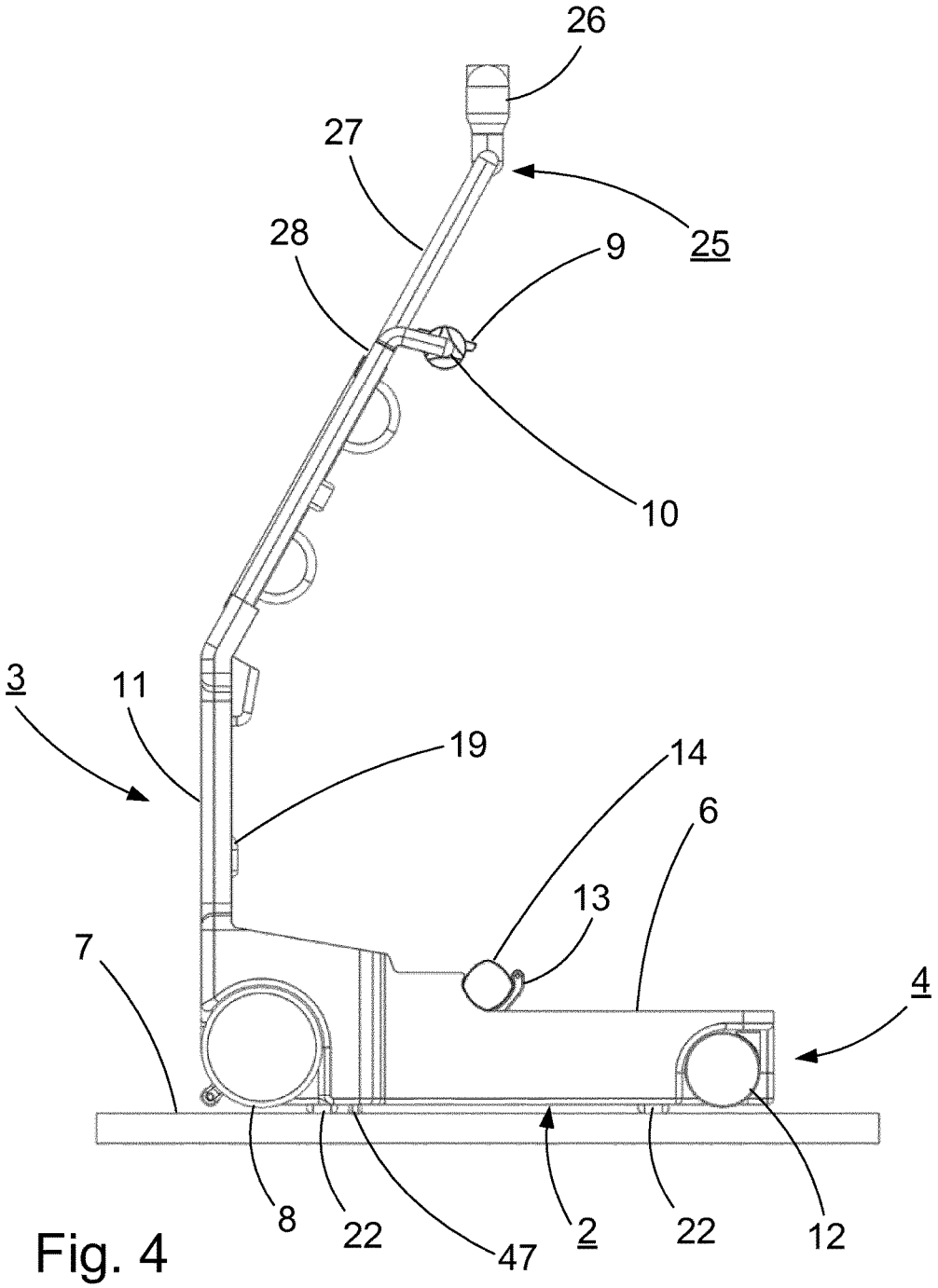
Figure 5:
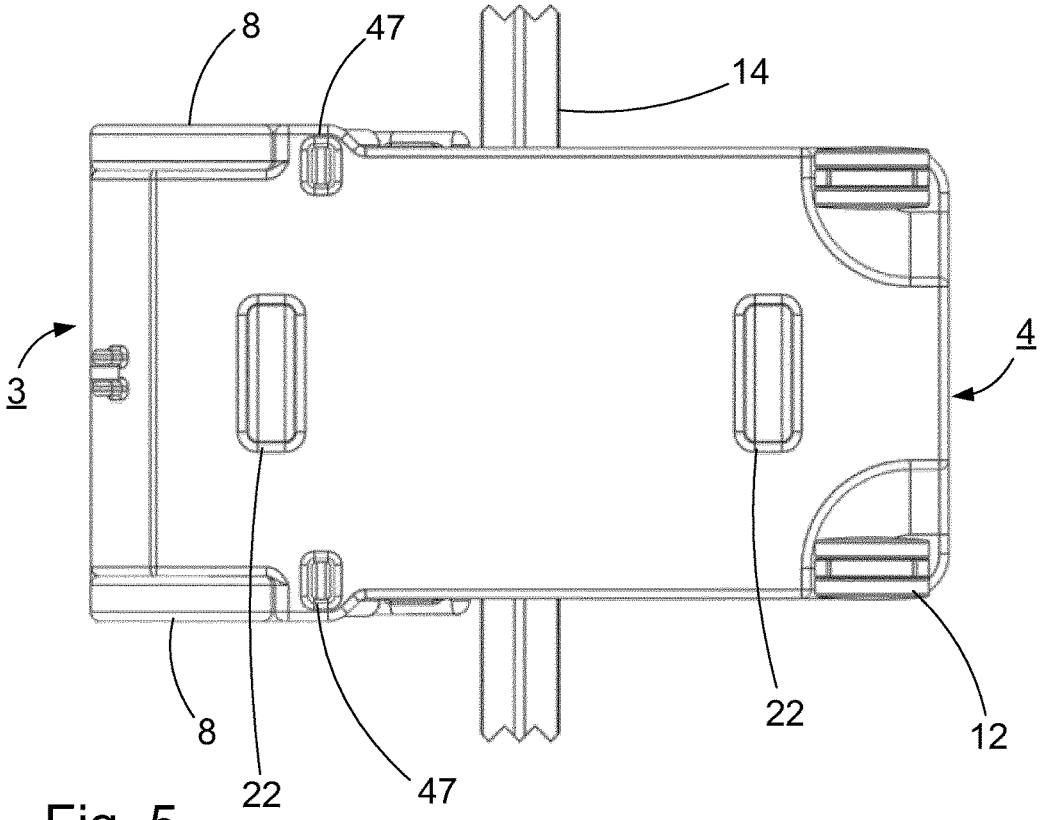
Figure 6:
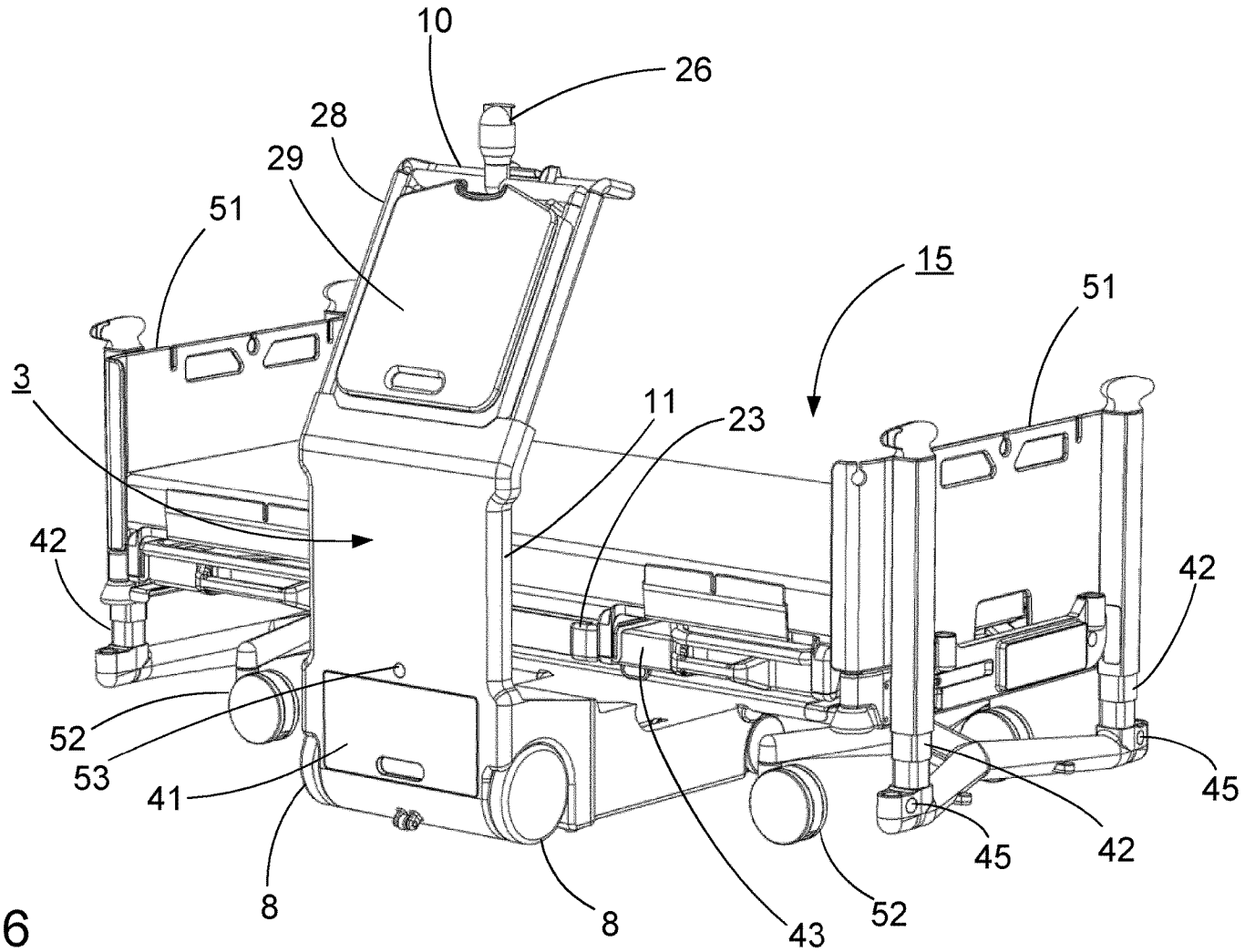
Figure 7:
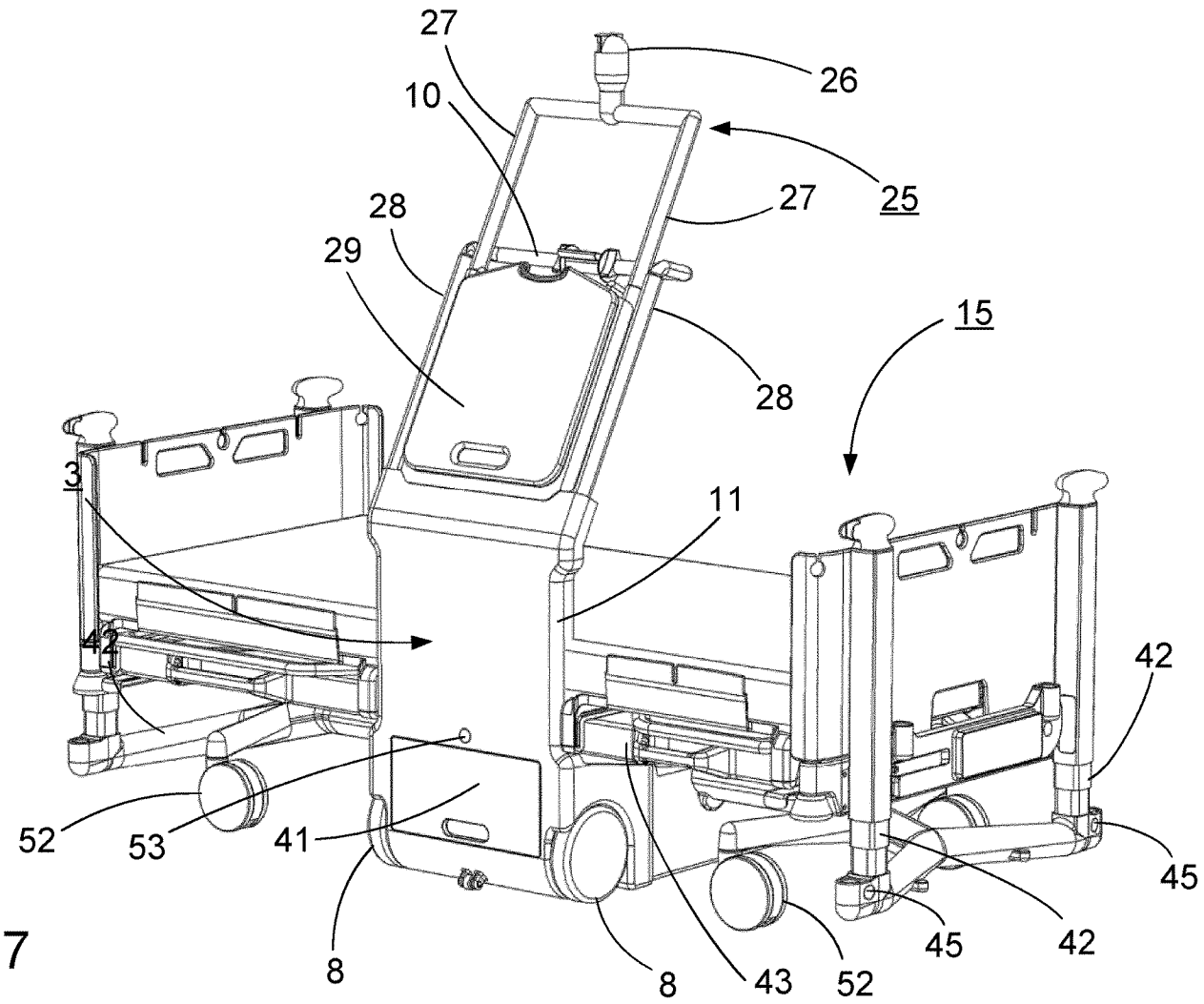
Figure 8:
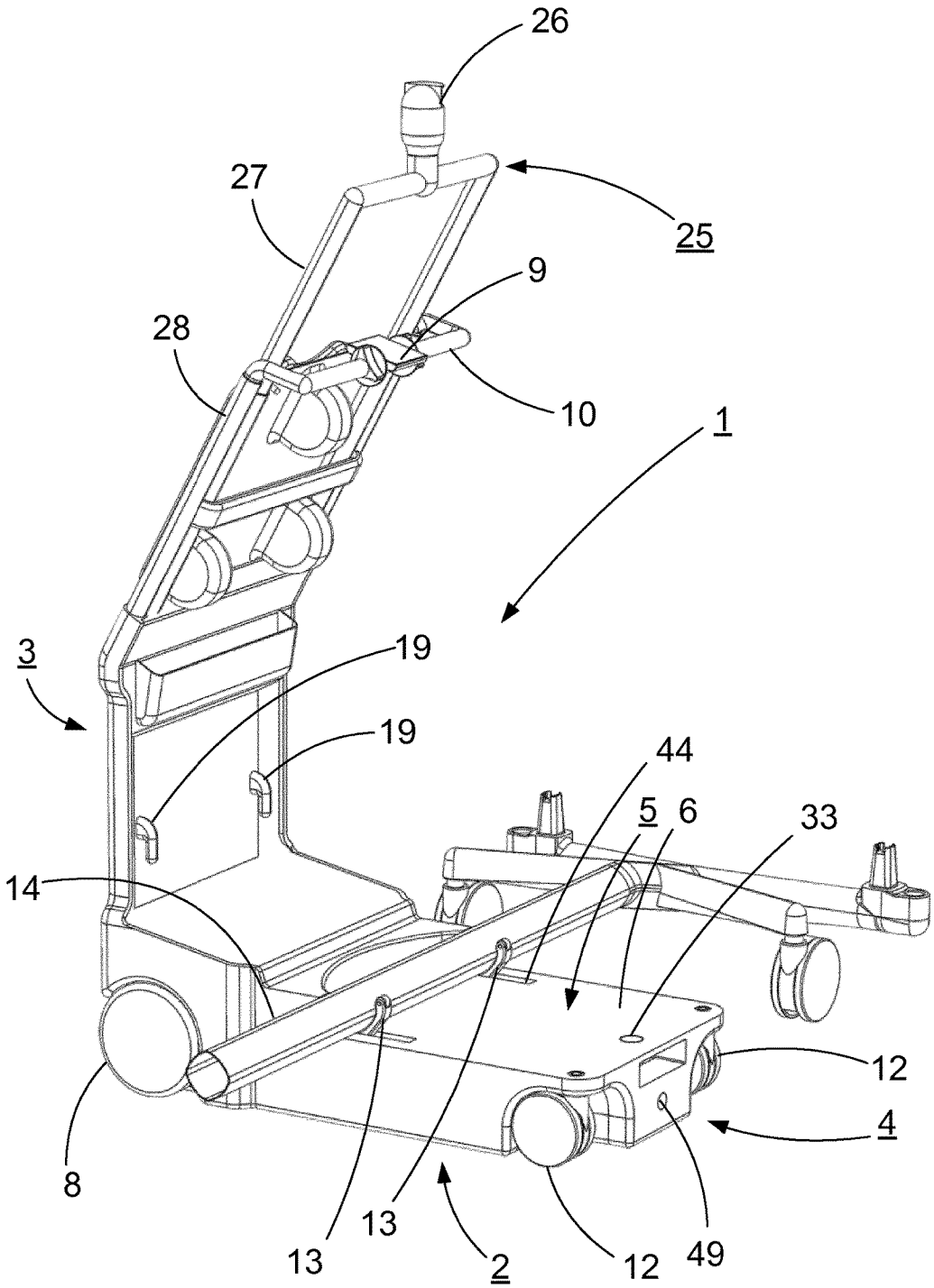
Figure 9:
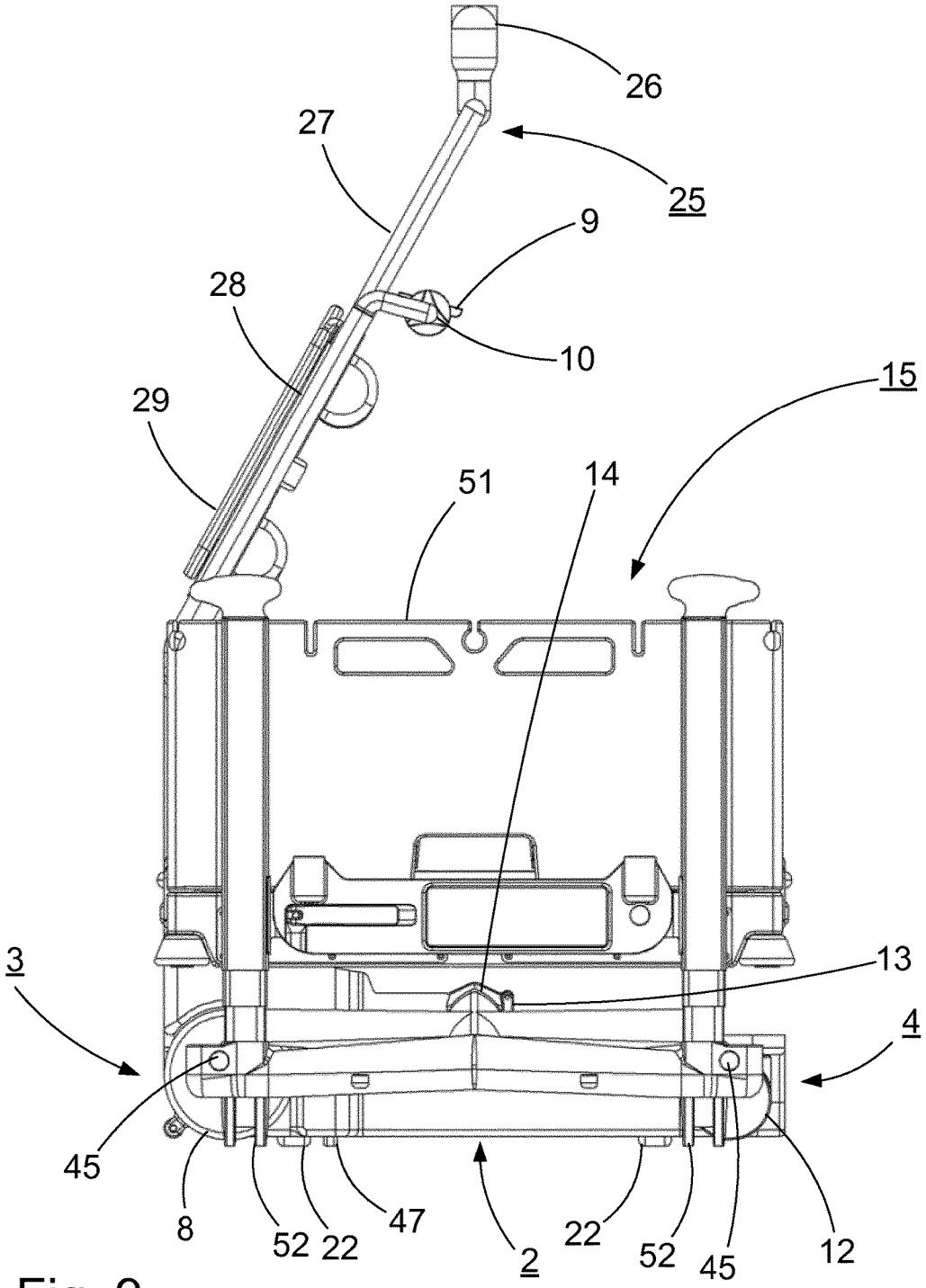
Figure 10:
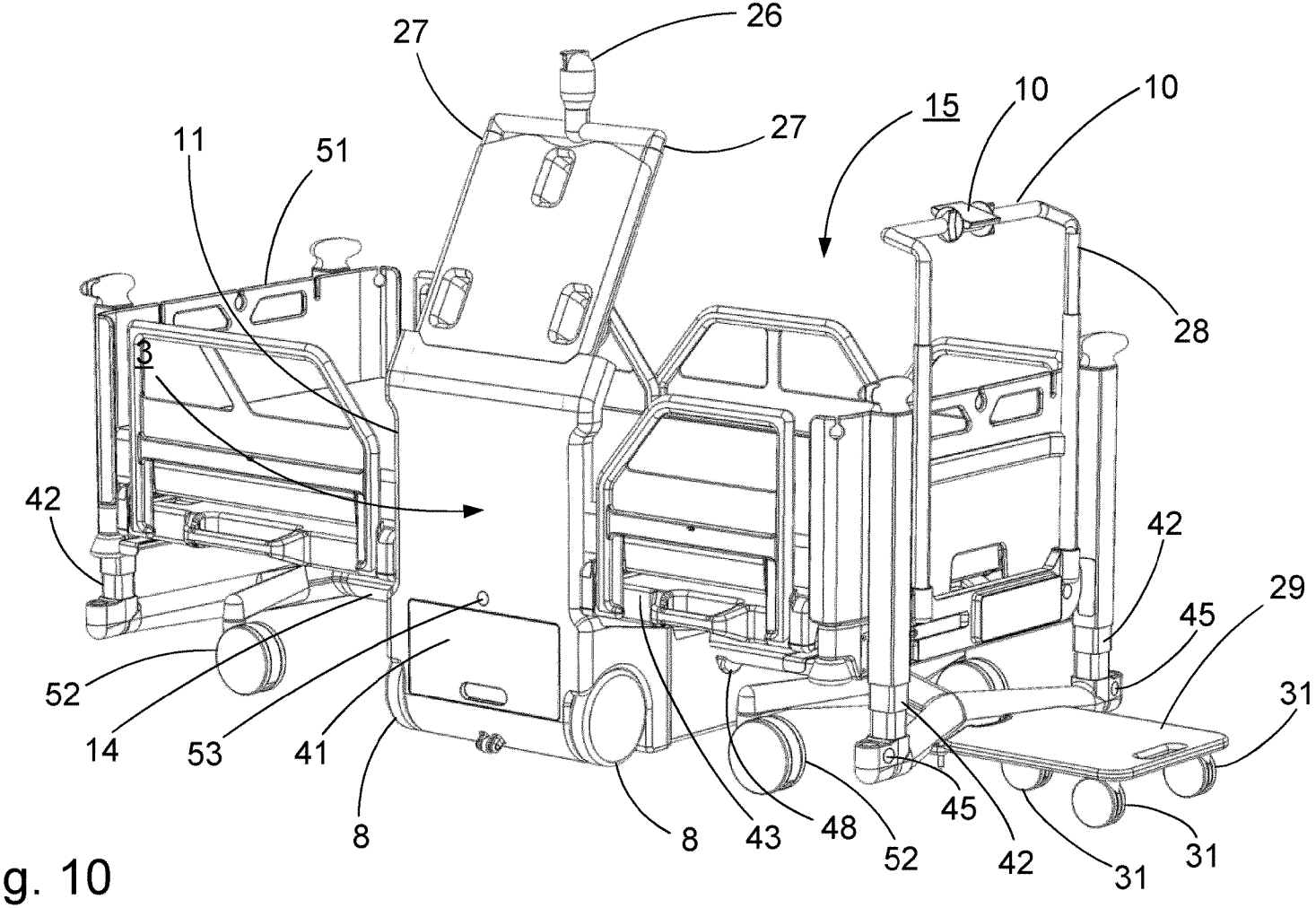
Figure 11:
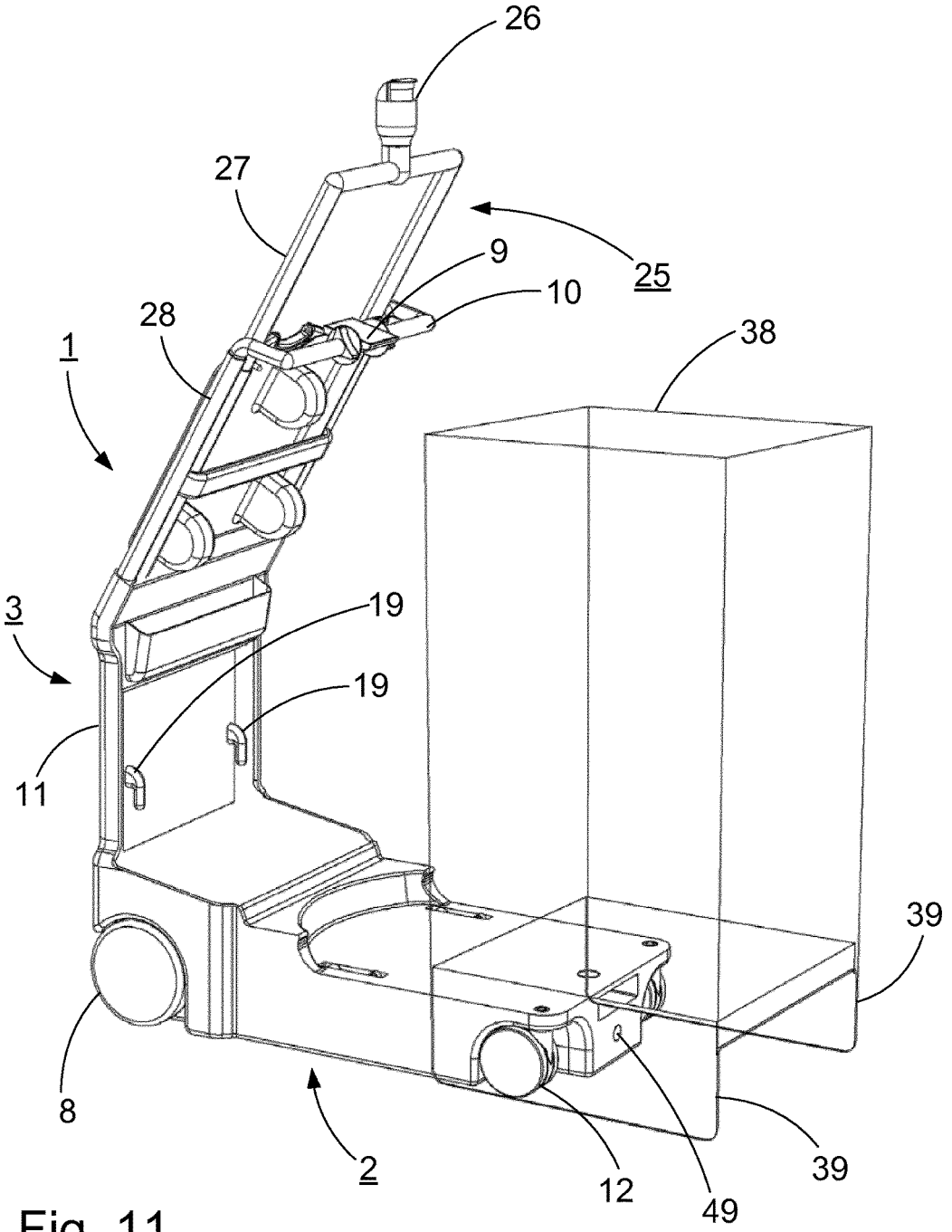
Figure 12:
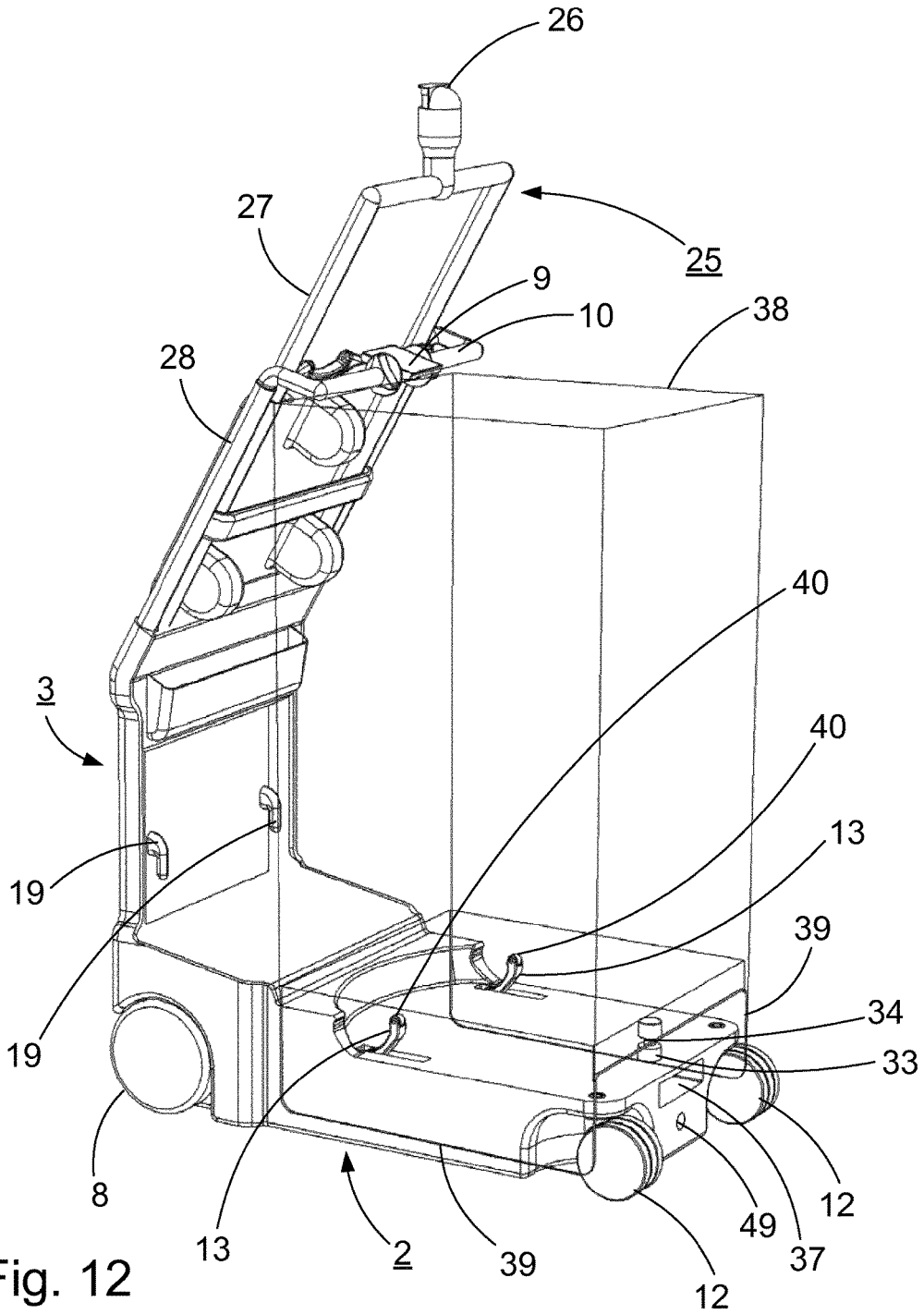
Figure 13:
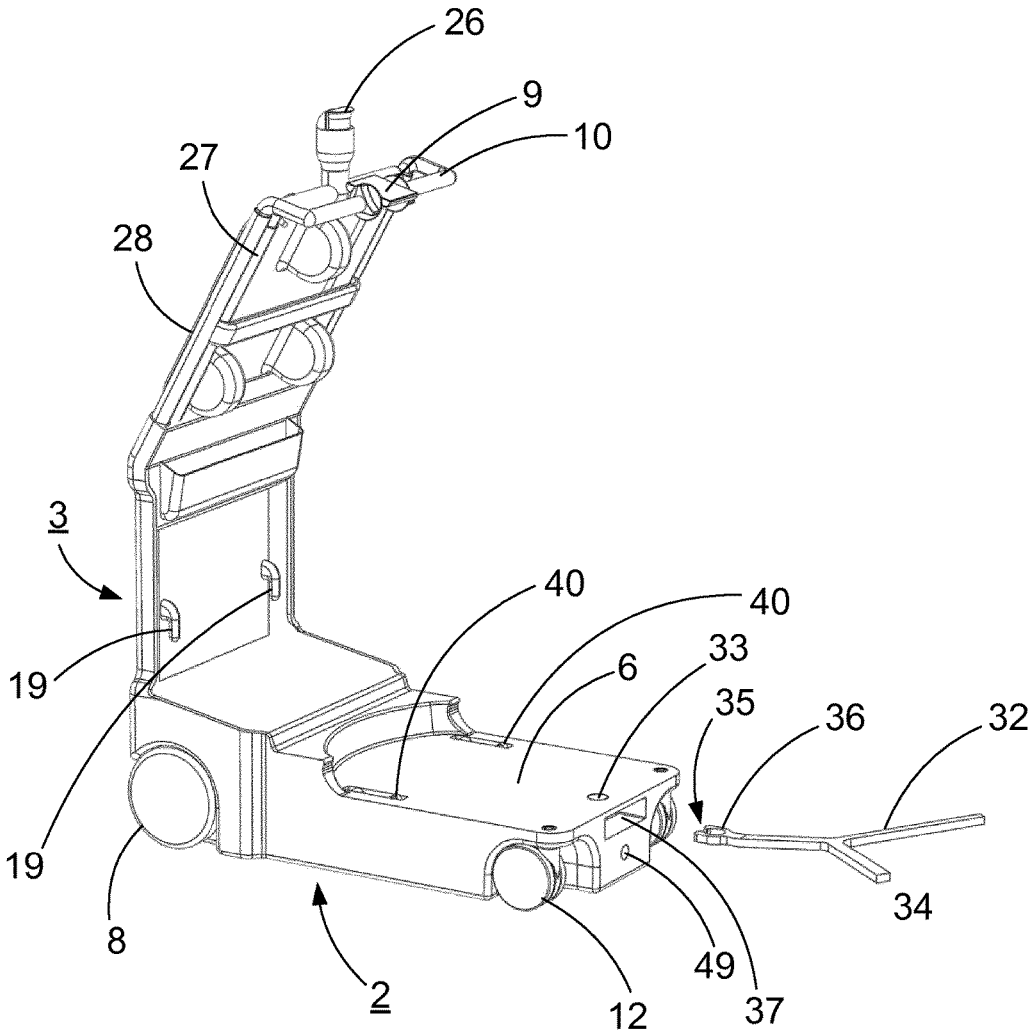
Figure 14:
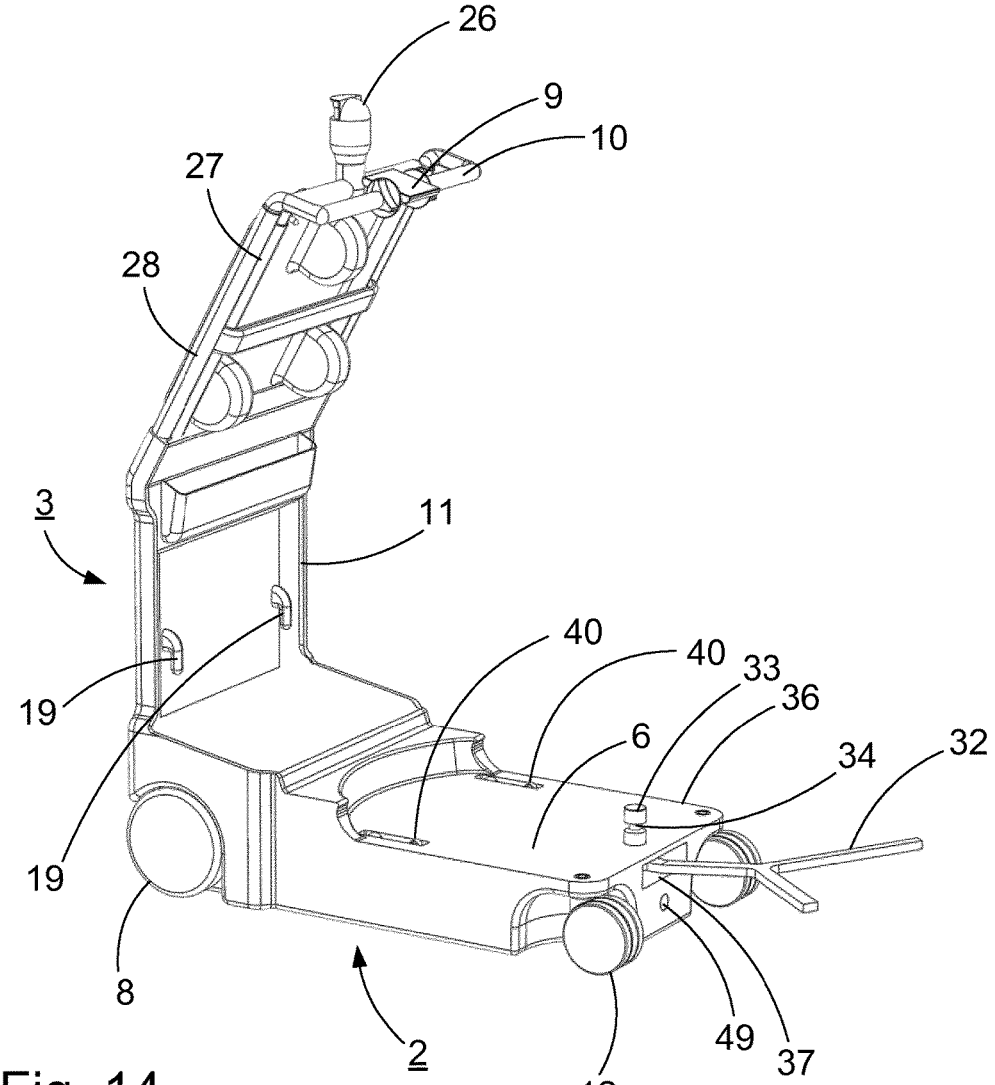

The invention will now be described in greater detail based on non-limiting exemplary embodiments and with reference to the schematic drawings on which:

FIG. 1 shows a perspective front view of a wheeled transportation device according the present invention, FIG. 2 shows a rear perspective view of the wheeled transportation device of FIG. 1, FIG. 3 shows a side view of the wheeled transportation device of FIG. 1, FIG. 4 shows a side view of the wheeled transportation device of FIG. 1 in engagement with a central longitudinal beam of a bed, FIG. 5 shows a bottom view of the wheeled transportation device of FIG. 1 in engagement with a central longitudinal beam of a bed, FIG. 6 shows a perspective view of the wheeled transportation device of FIG. 1 during engagement with an empty bed, FIG. 7 shows a perspective view of the wheeled transportation device of FIG. 1 in engagement with an empty bed, FIG. 8 shows a different perspective view of the transportation device of FIG. 1 during engagement with the bed of which parts have been removed for illustration purposes, FIG. 9 shows a side view of the transportation device in engagement with a bed and some of the wheels lifted off the ground, FIG. 10 shows a perspective view of the transportation device corresponding to that of FIG. 7 but manually adapted for transportation of the bed with a patient, FIGS. 11 and 12 show how a load may be lifted and transported by the transportation device, FIGS. 13 and 14 show how a tow bar of a trailer may be attached to the transportation device.

Turning first to FIG. 1, a perspective front view of an embodiment of a wheeled transportation device 1 according to the invention is shown. The wheeled transportation device 1 comprises a base part 2. The base part 2 has a front end 3, a rear end 4, and a lower and an upper part 5. In the base part sensors 49, 53 are provided at least front and back. The upper part 5 has a substantially horizontal and plane surface 6. The substantially horizontal and plane surface has an area suitable for a person to stand on. The substantially horizontal and plane surface 6 may be divided into more than one surface, i.e. sub-surfaces, such as one for each foot of a person standing there. In respect of the terms upper, lower, front, rear etc. these are to be understood in their normal sense for a wheeled transportation device 1 resting itself on a horizontal surface, in turn, referred to as ground 7 as best seen in FIG. 3 or 4.

The wheeled transportation device comprises a first pair of drive wheels 8. In the preferred embodiment the drive wheels 8 are located at the front 3 of the base part 2, preferably at the corners thereof. The drive wheels 8 are aligned on a common fixed axis, i.e. with coinciding axes, and individually controllable in either direction by an on-board computer, so as to allow the steering of the wheeled transportation device. The on-board computer is located at a suitably protected place within the wheeled transportation device 1, preferably within the base part 2. The wheeled transportation device 1 is preferably battery powered. Preferably there are two batteries of which at least one 41 is also located at a suitable place within the base part 2. The batteries supply the electric motors for the movable parts of the wheeled transportation device 1, as well as communication means, sensors, 26, 49, 50, the on-board computer, etc. The on-board computer runs software allowing autonomous steering of the drive wheels 8 and hence the transportation device 1. The drive wheels 8 may however also be controlled by an operator via manual input from an operator control panel 9 or the like, preferably by providing manual input to the computer. Alternatively, the computer could simply be bypassed when manual control is desired, i.e. overriding of the computer. According to a preferred embodiment the input panel 9 is located centrally on a removable handlebar 10 attached to the upper part 5 of the base part 2, preferably attached to an elevated part of the upper part 5, such has an upright 11, in which there are suitable sockets for receiving the ends of the tube sections 28 of the tube from which the handlebar 10 is formed. The sockets and hence the ends of the tube from which the handlebar 10 are formed is preferably arranged at an angle with respect to the upright 11. The central location of the input device allows easy control using the thumbs of the operator while still holding firmly onto the handlebar. Communication from the input panel 9 to the on-board computer is preferably wireless. Wireless communication is implemented in the transportation device anyway, as even an autonomous transportation device needs to communicate with other devices, in particular, as will be explained below, with beds. Alternatively, complementary connectors could be provided in the sockets of the upright and at the ends of the tube from which the handlebar 10 is formed, but for reasons to be described later this is less preferred.

A further pair of wheels 12 is located at the rear of the base part 2. These are preferably also located at the corners so as to provide good stability for the wheeled transportation device 1. Unlike the drive wheels 8, the wheels 12 are swivel wheels, i.e. wheels which do not have a fixed common axis. This allows the wheeled transportation device 1 to rotate on the spot, when the drive wheels 8 in the first pair of drive wheels 8 are rotated in opposite directions by their respective electric motors, thereby making the wheeled transportation device 1 very manoeuvrable.

In the substantially horizontal and plane surface 6 a pair of recesses 44 is provided. In these recesses 44 an engagement member in the form of two hooks 13 are accommodated. When not in use, the hooks 13 are retracted to a resting position at or below the substantially horizontal and plane surface 6, inter alia to protect them from damage and so as not to provide an obstacle for a person standing on the substantially horizontal and plane surface 6. The hooks 13 are movable between a resting engagement member position shown in FIG. 1, 2, 3, 6 11, 13 or 14 and an activated engagement member position as shown in FIG. 4, 7, 8, 9, or 12 where the hooks 13 extend above said substantially horizontal and plane surface 6.

The hooks 13 serve dual purposes. The prime purpose of the hooks 13 is to engage a central beam 14 of a bed 15, as seen in FIGS. 4, and 6 to 10. A bed with such a central beam 14 is inter alia known from WO-A-2014/057313, and is also the subject of the application PCT/IB2013/002454, both incorporated herein by reference. The beds described in these references also comprise computer control means and electric motors for lifting and lowering the patient support base etc. These electric motors operate telescopic lifting columns 42 of the bed in order to lift and lower the patient support base 43. For the proper engagement and securing of the central beam 14 the hooks 13 cooperate to clamp notches 18 and protrusions 17 provided in the upper part 5 of the base part 2 of the transportation device and preferably adapted to the cross-sectional profile of the beam of the bed 15. A secondary purpose of the hooks is to serve for a lifting mechanism, for lifting loads 38 such as a box pallet, a simple pallet, a cabinet, a container etc to be transported by the transportation as shown in FIGS. 11 and 12.

In addition to the hooks 13 the wheeled transportation device 1 has a further engagement member 19. The further engagement member 19 is located above said at least one substantially horizontal and plane surface 6, more specifically on the rear side of the upright 11. In the preferred embodiment the further engagement member 19 is a fixed member, as opposed to the movable hooks 13 of the first engagement member. The further engagement member 19 is preferably in the shape of at least one downwardly open hook. In alternative embodiment the hook is longitudinal, in the sense that it has a straight horizontal bar or tube connecting two curved end pieces corresponding to the hooks. Interconnecting the hooks would yield greater mechanical stability in the lateral direction of the wheeled transportation device 1.

The lateral stability is of importance because the wheeled transportation device 1 is adapted to move the bed 15 in its own lateral direction. For this the wheeled transportation device 1 has a second pair of drive wheels 22 arranged with coinciding second axes of rotation. Like the first pair of drive wheels 8, the wheels 22 of the second pair of drive wheels 22 are individually controllable, and everything mentioned about the control of the first pair of drive wheels 8 equally applicable to the second pair of drive wheels 22, including the manual control from the control panel 9. In order to further secure stability, the beam 14 of the bed 15 may have protrusions 48 serving as stops between which the wheeled transportation device is held in the lateral direction when engaged with a bed as illustrated in FIG. 10.

The coinciding axes of the second pair of drive wheels 22 are orthogonal to the likewise coinciding axes of rotation of the first pair of drive wheels 8, and generally arranged along a central vertical longitudinal symmetry plane of the wheeled transportation device 1. The wheels 22 of the second pair of drive wheels 22 are movable between a retracted resting position and an activated position. In the resting position, the second pair of drive wheels 22 is retracted into or at least towards the lower part of the base part 2, so that they are not in contact with the ground 7. In the activated position the wheels 22 of the second pair of wheels 22 protrude farther from the lower part of the base part 5 than the first pair of drive wheels 8 so as to be in contact with the ground 7, as can best be seen in FIG. 4. This arrangement of the second pair of wheels allows the wheeled transportation device to turn on the spot, i.e. with a turning circle hardly exceeding its own horizontal dimensions.

For transportation of a bed 15 the wheeled transportation device 1 engages the bed 15 as illustrated in FIGS. 6 to 10. Starting with FIG. 6, it is shown how the wheeled transportation device 1 moves itself under a bed 15. As can be seen this takes place from the side of the bed 15 rather than from the end thereof. This may happen automatically based on built-in sensors 26, 49 and wireless communication with the bed 15. When approaching the bed 15 the transportation device 1 communicates with the bed 15 causing the bed 15 to lower the patient support base 43, i.e. the upper part on which the mattress rests, by means of built-in electric motors operating a number of telescopic lifting columns 42. It also communicates to the bed 15, that the bed 15 should lock its swivel wheels 52 against rotation about both their horizontal and vertical axes. The wheeled transportation device 1 then places itself centrally under the bed 15, with the engagement member 19 positioned at a suitable part of the bed 15 such as the undercut protrusions 23 of the patient support base 43 also serving possibly to hold an additional cot side 24 or other part in place. Centrally is to be understood primarily in the lateral direction of the bed 15, evidently the wheeled transportation device could also place itself centrally under the bed 15 in the longitudinal direction of the bed, but this is as such less important. However, the beam 14 is preferably provided with a pair of protrusions 48 serving as stops for securing the wheeled transportation device 1 it its lateral direction when in engagement with the bed 15. When approaching the bed 15, the wheeled transportation device 1 may stop beside the bed 15 and lower the second pair of drive wheels 22. The wheeled transportation device 1 may now move laterally by means of the second pair of drive wheels 22, in order to align itself with the location between the protrusions 48. When the second pair of drive wheels are in the activated, lowered position, the wheeled transportation device is held level by means of a pair of stabiliser wheels 47 at the edges of the lower part of the wheeled transportation device.

When the wheeled transportation device 1 is properly aligned with the beam 14 of the bed 15, i.e. the protrusions 48, the second pair drive wheels 22 may be raised again, allowing the first pair drive wheels 8 to drive the central location under the bed 15. Needless to say that the proper alignment, may under circumstances necessitate several engagements of both the second pair of drive wheels 22 and the first pair of drive wheels 8.

In this position the movable hooks 13 may engage the beam 14 and the wheeled transportation device may communicate to the bed to unlock its wheels 52. With the wheels 52 of the bed 15 unlocked the wheeled transportation device 1 to pull the bed 15 sideways, e.g. away from a wall or other obstacle, hindering the full manoeuvrability of the bed 15.

If a more firm engagement is needed, because a longer transportation is in progress, the wheeled transportation device 1 communicates with the bed 15 causing it to raise the patient support base 43, by means of the telescopic lifting columns 42 of the bed 15, whereby the engagement member 19 engages the undercut protrusions 23 and the wheeled transportation device 1 gets lifted off the ground 7 and towards the central beam 14 in a horizontal position. There is now a firm engagement between the wheeled transportation device 1 at the side of the patient support base 43 of the bed 15 as well as centrally below the patient support base 43 at the beam 14, where the activated hooks 13 firmly engage the central beam 14 by gripping or clamping it, e.g. by pressing it into engagement with the notches 18 and protrusions 17. In this position where the first pair of drive wheels 8 and the swivel wheels 12 are off the ground 7, whereas the second pair of drive wheels 22 are in contact with the ground 7. This ensures a tight and stable engagement without any play between the bed 15 to be transported and the wheeled transportation device 1, in turn allowing precise control of the motion of the bed 15 during transport.

The drive wheels 22 do not need to be biased very hard against the ground 7, as they need not support the weight of the bed 15. The biasing force needs only to be big enough to secure the necessary friction between the drive wheels 22 and the ground 7 to proper ensure traction when the wheeled transportation device 1 is to move the bed 15. Accordingly the drive wheels 22 are spring loaded, to ensure a proper and uniform bias of both drive wheels 22 towards the ground, in turn, ensuring uniform wear of the drive wheels 22 over time. The spring biasing force of the stabilizer wheels 47 is lower than the spring bias of the second pair of drive wheels 22, as the stabilizer wheels do not need provide any traction, but merely serve to keep the wheeled transportation device 1 horizontal in the lateral direction, when manoeuvring sideways in unloaded condition.

It should be noted that the engagement member 19 may be constructed in many other ways than the elongated hook formed of the horizontal bar or tube 20 and ends 21, depending of course on the actual construction of the bed 15, which it must be able to engage. The important part is that the engagement must be firm and allow the patient support base 43 of the bed 15 to lift the first pair of drive wheels 8 of the wheeled transportation device 1 off the ground 7, i.e. vertically by using the vertically operating lifting mechanism of the bed 15, such as the telescopic lifting columns 42. Likewise, the undercut protrusions 23 are merely an example of how the part of a bed 15, which the engagement means 19 is to engage, may be constructed.

Having engaged the bed 15, a sensor holder 25 is extended to a position where a sensor 26 mounted on the sensor holder 25 is located centrally above the bed 15, in order to have good coverage of the area around the bed 15. The sensor 26 could be an omnidirectional sensor potentially covering 360 degrees around the wheeled transportation device 1, preferably in conjunction with suitably programmed software on the on-board computer, to suppress input from irrelevant directions. In the illustrated embodiment, however, a wide angle sensor covering less than 360 degrees is used. Accordingly the sensor 26 is mounted in such a way that it may be turned with respect to the sensor holder 25 in order to have a field of view in the direction of transport, as can be seen by comparison between the various figures. How the sensor holder 25 is constructed in detail is not important as such, as long as it is able to reach the point centrally over the bed 15. The preferred embodiment, however, comprises an inverted u-shaped tubular member, generally arranged with the tube sections of the legs 27 of the U-shape in parallel with the tube sections 28 of the handlebar 10. The legs 27 of the U-shape are preferably telescopic tubes, allowing them to automatically extend using built-in electric motors under the control of the on-board computer. Evidently there will be dead angles for the sensor 26 in close proximity to the bed, e.g. from the end boards 51. Generally the extended position is however sufficiently high to make these dead angles so small that they will not pose a problem. However, since the wheeled transportation device 1 comprises communication means for wireless communication with the bed 15 it is envisaged to have sensors 45 built into either end of the bed frame. Sensors 46 are also built into the base part 2 of the wheeled transportation device 1. Such sensors are readily available at low cost, as they are nowadays widely used in automotive vehicles.

By means of the sensor 26 in the extended position and possibly sensors in the bed 15 or in the base part 2, the on-board computer may now transport the bed 15 autonomously from one location to another. The navigation software and other software needed for doing so is readily available and does not form part of the invention as such.

Arrived at the destination the process may be reversed and the wheeled transportation device 1 be disengaged from the bed 15. The wheeled transportation device 1 may then autonomously move itself to another destination where it is needed. This may be done under control of the on-board computer based on the inputs from the sensor 26 in the retracted position and the sensors 49, 53 in the base part 2. The extended position of the sensor 26 is not needed as there will be no dead angles caused by a bed 15.

Normally only empty beds 15 will be transported this way. Beds 15 occupied by patients will normally be accompanied by a person, for objective and subjective safety and security reasons, i.e. for the patient to both be and feel secure.

The wheeled transportation device 1 is also adapted to cater for this accompanying person, as can be seen in FIG. 10. In FIG. 10 it can be seen that the wheeled transportation device 1 has engaged itself with the beam 14 of the frame of a bed 15 as described above. This may, however, also be performed manually by an operator, i.e. the accompanying person. If, as preferred, the wheeled transportation device is to be controlled by the operator, i.e. the accompanying person, the sensor 26 need not be in the extended position. The accompanying person may then switch the wheeled transportation device 1 to a manual control mode, e.g. via suitable input to the operator control panel 9. Evidently this manual override may be activated at other stages in the process. The reason operator control is currently preferred, is inter alia because autonomous automated transportation may lack acceptance with both the accompanying person and the patient.

For the operator, the wheeled transportation device 1 comprises a dolly 29 suitably accommodated in a tray 30 between the parallel tubes 28 of the removable handlebar 10 when the dolly 29 is not in use. The tray 30 is not absolutely necessary, but much preferred in order not to spread dirt and the like picked up by the wheels 31 from the ground 7, onto the bed and the wheeled transportation device 1, itself when the dolly 29 is not in use. This dolly 29 may be removed from the tray 30 and attached to the frame of the bed 15, and serve as a platform for the operator carrying his full weight during transportation of the bed 15. Likewise the handle bar 10 may be removed from the sockets in the upright 11 and placed instead in suitable sockets in the bed 15. The operator control panel 9 will then be easily accessible for the operator standing on the dolly 29, allowing the operator to provide manual input to the on-board computer controlling the second pair of drive wheels 22 as well as possibly the first pair of drive wheels 8 and other functionalities of both the wheeled transportation device 1 and the bed 15. The communication between the operator control panel 9 and the on-board computer is very easily established when, as mentioned above, the communication is wireless. Standing on the dolly 29, the operator may then drive the bed 15 with the patient to one or more desired destinations. This is economically beneficial, because the speed which may be reached is substantially higher than if the operator was to push the bed 15 manually. Manual pushing would hardly ever exceed a speed of approximately 4 km/h, whereas driving it as described could easily achieve the double speed. The upper limit is not set by the wheeled transportation device 1 itself, but rather depends on external circumstances, such as the safety of an occupant and pedestrians in corridors and the like. Since the dolly 29 must be able to follow all movements of the bed 15, the wheels 31 are preferably swivel wheels, allowing inter alia the dolly to follow a bed 15 to turning on the spot. When the trip is finished, the dolly 29 and the handlebar 10 with the operator control panel 9 may manually be placed again in the tray 30 and sockets in the upright 11, and the wheeled transportation device 1 rendered autonomous again for new tasks. Information about such new tasks may evidently also be received via wireless communication means. Such wireless means could be the same as those used for the sensor 26 and the operator control panel 9, or they could all be different. For many in-door applications, standard medium range wireless means such as WiFi would be suitable for receiving tasks and other external information such as overall location information, whereas short range wireless communication means such as Bluetooth would be suitable for communication between the on-board computer and the sensor 26, the bed 15, the operator control panel 9, etc.

However, if the operator is in need of transportation, e.g. after finishing the transportation of the bed 15, the wheeled transportation device 1 may also serve as a single person personnel transporter. The operator would then not reengage the autonomous mode by means of the control panel 9 after having placed the dolly 29 in the tray 30 again and placed the handlebar in the sockets of the upright 11 again. Instead he would simply place himself with his feet on the substantially horizontal and plane surface 6 and drive away on the wheeled transportation device 1, using inputs to the operator control panel 9 to steer, accelerate, brake, reverse, etc. the wheeled transportation device 1 as he likes. After transporting himself, he could reengage the autonomous mode, or he could transport other objects, such as a new bed 15 with another patient, around as already described. He could also attach a tow bar 32 of a trailer, or the first tow bar 32 of an assembled train of trailers, to an attachment pin 33 on the wheeled transportation device 1, in order to drive them to another location. All of this could be repeated until manual control is no longer desired, and the operator finally reengages the autonomous mode.

The attachment pin 33 is controlled in the upward and downward direction, between a retracted position as shown in FIGS. 1, 2, 8, 11 and 13, and a raised position shown in FIGS. 12 and 14. The attachment pin 33 is preferably cylindrical with a narrower also cylindrical middle section 34, as can be seen in FIGS. 12 and 14. The narrower middle section 34 may in an intermediate position be aligned with a generally funnel-shaped insertion guide 37 for the tow bar 32 of the trailer, having in turn a generally open key-hole shape with an opening 35 matching the narrower middle section 34 of the attachment pin 33 and a wider inner part 36 matching the overall diameter of the attachment pin 33. This allows the tow bar 32 to slide around the middle section of the attachment pin 33 in the intermediate position and the overall diameter of the attachment pin 33 to engage and hold the tow bar 32 when the attachment pin 33 is moved out of alignment with the insertion guide 37, e.g. raised as illustrated in FIG. 14. The skilled person, however, will realize that other couplings could be used instead, e.g. electromagnetic couplings, which would be easily controllable by the software of the on-board computer.

This upward and downward control of the attachment pin 33 may be under control of the on-board computer, thus allowing the wheeled transportation device 1 to autonomously locate a trailer using its built-in sensors 26 and 49, autonomously attach itself thereto, and autonomously transport it to another location, and autonomously detach itself from the trailer.

Furthermore, the attachment pin 33 serves a dual purpose, as illustrated in FIGS. 11 and 12. In FIGS. 11 and 12 a load 38 is schematically outlined in the form of a box pallet. The load 38 could be any kind of load such as a simple pallet, a cabinet, a container etc. as long as it has downwardly extending legs or the like, in the illustrated example two legs in the form of flanges 39, allowing the wheeled transportation device 1 to enter under it as illustrated in FIG. 11.

This allows the wheeled transportation device 1 to autonomously position itself under the load 38 and then pick it up by moving the hooks 13 into their activated engagement member position and the attachment pin 33 to the raised position, thereby lifting the load 38 off the ground 7 for transportation. This autonomous positioning may involve the activation of the second pair of drive wheels 22 for lateral motion, as explained above in conjunction with the alignment with the bed 15. Preferably, the load 38 is provided with a suitable recess or the like in the bottom, which the attachment pin 33 may engage in order to secure the lifted load 38 against sliding. Since the hooks 13 perform an angular movement when moving up and down between the retracted position shown in FIG. 11 and the activated position shown in FIG. 12, the tips of the hooks 13 are preferably provided with rollers 40, in order to reduce friction against the bottom of the load 38. To correctly identify a load 38 to be picked up and moved, the wheeled transportation device 1 has suitable detection means for detecting an identifier of the load 38. The detection means could be a camera for scanning a bar or QR code, a transmitter/receiver for detecting RFID tags, or a detector for any other commonly used identifier means. Arrived at the destination, the wheeled transportation device 1 may retract the attachment pin 33 and move the hooks 13 to the resting engagement member position, so that none of them protrude over the generally horizontal and plane surface 6, thereby placing the load 38 on the ground 7. Having delivered the load 38 in this way, the wheeled transportation device 1 may continue with other tasks.

It could also be envisaged that a cart similar to the load 38, but provided with wheels, could be picked up and transported by the wheeled transportation device 1. In this the wheeled transportation device 1 would place itself under the cart in the very same way as described in conjunction with the load 38 above, and engage the attachment pin 33 at a suitable attachment point, such as a recess under the bottom thereof. Depending on the wheel layout of the cart and the length thereof, this could then work as an articulated vehicle as known from road trucks with semi-trailers. This will in principle work only for a single cart, but would allow larger weights than possible the load 38, because the wheels of the cart itself would support at least some of the load, and not the wheeled transportation device 1.

Eventually, however, the wheeled transportation device 1 will have used up most of the energy stored in the batteries, and will no longer be able to perform its duties. Even fast recharging of a built-in battery will involve unnecessary idle times, and it is therefore preferred to change battery for new energy. Preferably, the wheeled transportation device 1 comprises at least one interchangable main battery 41, and at least one built in back-up battery. The back-up battery inter alia provides energy during the exchange of the main battery 41 as an automated exchange of the main battery 41 would otherwise be difficult. The main battery 41 is preferably located at the front end 3 of the wheeled transportation device 1. This location has two advantages. First is easy access when battery change is needed. Second is that this location is generally above or between the pair of drive wheels 8, the weight of the battery is thus largely on the wheels 8, thereby providing good traction.

When sensing that the main battery 41 is getting low on energy, the wheeled transportation device 1 may wirelessly, e.g. via WiFi and/or LAN inquire, which exchange station with a fully charged battery is the most proximate. The exchange stations may be distributed suitably over a site such as a hospital, and may all be in communication with each other and other wheeled transportation devices 1 via LAN and/or WiFi. If a fleet of wheeled transportation devices 1 are managed centrally, i.e. assigned tasks by a central computer, the central computer could evidently also command an otherwise idle wheeled transportation device 1 to exchange battery 41 earlier than absolutely necessary, or command the wheeled transportation device 1 to change battery 41 en route, be it between two tasks or during a task without a tight schedule.

Arrived at the exchange station the wheeled transportation device 1 finds a vacant dock for the battery 41. This may happen entirely autonomously, but preferably communication takes place between the exchange station and the wheeled transportation device 1 for easy location of the vacant dock. The wheeled transportation device 1 enters the dock front end 3 first and the dock locks on to the battery 41, so that the battery 41 is extracted when the wheeled transportation device 1 reverses out of the dock, now powered by the back up battery. The wheeled transportation device now selects and enters a dock with a charged battery front end 3 first, whereby the charged battery 41 gets inserted into the base part 2 of the wheeled transportation device 31. The dock now releases the battery 41, and the wheeled transportation device 1 can reverse out with the new charged battery 41 inserted.

The back up battery is preferably not changed but instead charged from the main battery 41.

As will be understood from the above the present invention provides a versatile transportation device 1, useful for a wide range of both autonomous tasks and manually controlled tasks in a hospital environment. The invention is, however, not limited to the disclosed embodiments, and the skilled person will be able to devise numerous embodiments and functionalities without parting from the scope of the invention as expressed in the claims. In particular he will understand that the combined use of the first pair of drive wheels 8 and the second pair of drive wheels 22, allows the good positioning of the wheeled transportation device 1 with respect other objects irrespective of the nature of the object. This would inter alia allow the wheeled transportation device 1 to carry a cleaning device such as a vacuum cleaner, and be able to get in into the corners with such a cleaning device.

The invention claimed is:

1. A wheeled transportation device comprising a base, where the base comprises a front end, a rear end, an upper part and a lower part, said lower part comprising a number of wheels and said upper part comprising at least one substantially horizontal and plane surface, said wheeled transportation device comprising at least one movable first engagement member adapted to engage a frame part of a bed, said movable first engagement member being movable between a resting engagement member position and an activated engagement member position, said movable first engagement member extending above said substantially horizontal and plane surface in the activated engagement member position, wherein said upper part comprises a further engagement member located above said at least one substantially horizontal and plane surface, and wherein said resting engagement member position is located at or below said at least one substantially horizontal and plane surface.

2. A wheeled transportation device according to any one claims 1, wherein said movable first engagement member comprises a pair of hook members.

3. A wheeled transportation device according to claim 1, wherein said number of wheels comprises a first pair of drive wheels arranged with coinciding first axes of rotation, each wheel in said pair being driven by an individually controllable electric motor.

4. A wheeled transportation device according to claim 3, wherein said number of wheels comprises a second pair of drive wheels arranged with coinciding second axes of rotation orthogonal to said coinciding first axes of rotation, each wheel in said pair being driven by an individually controllable electric motor, said second pair of wheels being movable between a retracted resting position and an activated position.

5. A wheeled transportation device according to claim 3, where the wheeled transportation device is generally symmetrical about a longitudinal vertical plane, and wherein the coinciding second axes of rotation are arranged in said longitudinal vertical plane.

6. A wheeled transportation device according to claim 1, wherein said further engagement member is adapted to engage a patient support base of a bed.

7. A wheeled transportation device according to claim 1, wherein said further engagement member is a downwardly open fixed hook member.

8. A wheeled transportation device according to claim 1 further comprising a movable pin with a vertical longitudinal axis, the pin being movable along said vertical longitudinal axis.

9. A wheeled transportation device according to claim 1, wherein the wheeled transportation device comprises a built-in control computer, sensors, control means for motors, and communication means.

10. A wheeled transportation device according to claim 1, wherein the computer comprises software adapted for autonomous control of the transportation device based on input from said sensors.

11. A wheeled transportation device according to claim 1, further comprising manual input devices adapted to allow manual control of the wheeled transportation device.

12. A wheeled transportation device according to claim 1, wherein the at least one movable first engagement member is adapted to engage at least one horizontal beam in a frame part of a bed.

13. A wheeled transportation device comprising a base, where the base comprises a front end, a rear end, an upper part and a lower part, said lower part comprising a number of wheels and said upper part comprising at least one substantially horizontal and plane surface, said wheeled transportation device comprising at least one movable first engagement member adapted to engage a frame part of a bed, said movable first engagement member being movable between a resting engagement member position and an activated engagement member position, said movable first engagement member extending above said substantially horizontal and plane surface in the activated engagement member position, where said upper part comprises a further engagement member located above said at least one substantially horizontal and plane surface, wherein said number of wheels comprises a first pair of drive wheels arranged with coinciding first axes of rotation, each wheel in said pair being driven by an individually controllable electric motor.

14. A wheeled transportation device according to claim 13, wherein said number of wheels comprises a second pair of drive wheels arranged with coinciding second axes of rotation orthogonal to said coinciding first axes of rotation, each wheel in said pair being driven by an individually controllable electric motor, said second pair of wheels being movable between a retracted resting position and an activated position.

15. A wheeled transportation device according to claim 13, where the wheeled transportation device is generally symmetrical about a longitudinal vertical plane, and wherein the coinciding second axes of rotation are arranged in said longitudinal vertical plane.

16. A wheeled transportation device comprising a base, where the base comprises a front end, a rear end, an upper part and a lower part, said lower part comprising a number of wheels and said upper part comprising at least one substantially horizontal and plane surface, said wheeled transportation device comprising at least one movable first engagement member adapted to engage a frame part of a bed, said movable first engagement member being movable between a resting engagement member position and an activated engagement member position, said movable first engagement member extending above said substantially horizontal and plane surface in the activated engagement member position, where said upper part comprises a further engagement member located above said at least one substantially horizontal and plane surface, wherein said further engagement member is a downwardly open fixed hook member.

* * * * *